United States Patent [19]

Steffen

[11] 4,077,134

[45] Mar. 7, 1978

[54] METHOD AND STRUCTURE FOR OPTIMIZING ATMOSPHERIC ENVIRONMENT TO PRESERVE STORED FOOD GRAINS IN THE CURING AND POST CURING STATE

[76] Inventor: Sylvester L. Steffen, R.R. 3, New Hampton, Iowa 50659

[21] Appl. No.: 704,996

[22] Filed: Jul. 14, 1976

[51] Int. Cl.[2] ..... F26B 3/00

[52] U.S. Cl. ..... 34/22; 34/181; 98/55

[58] Field of Search ..... 34/22, 27, 38, 169, 34/181, 191, 210, 212; 98/55

[56] References Cited

U.S. PATENT DOCUMENTS

| | | | |
|---|---|---|---|
| 1,571,227 | 2/1926 | Barducci | 34/191 X |
| 2,782,705 | 2/1957 | Breidert | 95/55 |
| 3,196,774 | 7/1965 | Kripal | 34/191 X |
| 3,380,174 | 4/1968 | McClaren | 34/169 X |

*Primary Examiner*—John J. Camby

*Attorney, Agent, or Firm*—Henderson, Strom & Sturm

[57] ABSTRACT

An apparatus and method for storing grain wherein improved and efficient ventilation is achieved and internal ventilation is practiced without subjecting the stored grain to overdrying and overheating.

12 Claims, 19 Drawing Figures

METHOD AND STRUCTURE FOR OPTIMIZING ATMOSPHERIC ENVIRONMENT TO PRESERVE STORED FOOD GRAINS IN THE CURING AND POST CURING STATE

BACKGROUND OF THE INVENTION

The present invention relates generally to an improved storage apparatus and method for storage and management of food grains, and more particularly to an apparatus capable of substantially duplicating the natural environment of grain exposed in the open air by providing improved and efficient ventilation of the stored grain within the storage structure.

In the field of bulk storage of grain, it is generally assumed that when grain moistures are below a fixed arbitrary level, the grain is safe from deterioration. Grain is generally dried to a given level and left in storage until used or sold.

Those concerned with bulk storage of food grains know that neglect of the grain in storage can result in gross deterioration of the stored grain. The moisture in the stored grain localizes in the upper portion of the grain mass and generally towards the center. Also, moisture accumulates in the interface between the grain mass and the bin wall due to condensation. These areas of localized moisture provide the conditions that encourage mold and bacterial infestation.

Bin structures and storage techniques heretofore employed are capable of controlling the buildup of localized moisture by ventilating the stored grain with a throughput of atmospheric air. This method of ventilation, however, can result in overdrying and overheating of the grain. The undesirable results of overdrying and overheating are discussed in detail in Steffen's patent application Ser. No. 422,760, filed Dec. 7, 1973 and patent application Ser. No. 642,577, filed Dec. 19, 1975.

Evacuation of the heat and moisture from the space above the stored grain, without allowing a throughput of atmospheric air, substantially eliminates the danger of overdrying and overheating the grain. Steffen teaches this technique as a portion of the process of co-pending patent application Serial No. 642,577. However, the problem of localized moisture at the point of contact between the bin wall and the stored grain as well as the problem of a moisture differential between the top and bottom of the grain mass still exists.

One of the most critical problems in the management of stored grain is to provide an environment that will yield uniform high quality grain.

SUMMARY OF THE INVENTION

This invention teaches an apparatus wherein and a method whereby stored grain is exposed to conditions that yield a uniform high quality grain. The bin structure provides improved and efficient ventilation of the stored grain within the storage apparatus by providing a greater area of surface contact between the stored grain and the air and by allowing for internal circulation within the grain bin.

It is the object of the present invention to provide a storage apparatus designed to optimize the use of freely available atmospheric resources.

Another object of this invention is to provide a storage apparatus wherein the natural environment of grain exposed in the open air is substantially duplicated and natural seed conditions are perpetuated.

A further object of this invention is to provide a storage apparatus and storage method whereby internal circulation of air is accomplished without introducing atmospheric air into the structure.

A still further object of this invention is to provide a storage apparatus wherein grain can be cured and the same structure can be closed to provide internal circulation of the air.

Still another object of this invention is to provide a storage apparatus wherein the area of surface contact between the stored grain and the air is increased to provide improved ventilation of the stored grain.

Other objects, advantages and novel features of the present invention will become apparent from the following detailed description of the invention when considered in conjunction with the accompanying drawings.

DESCRIPTION OF THE PREFERRED EMBODIMENT

Figure 1:
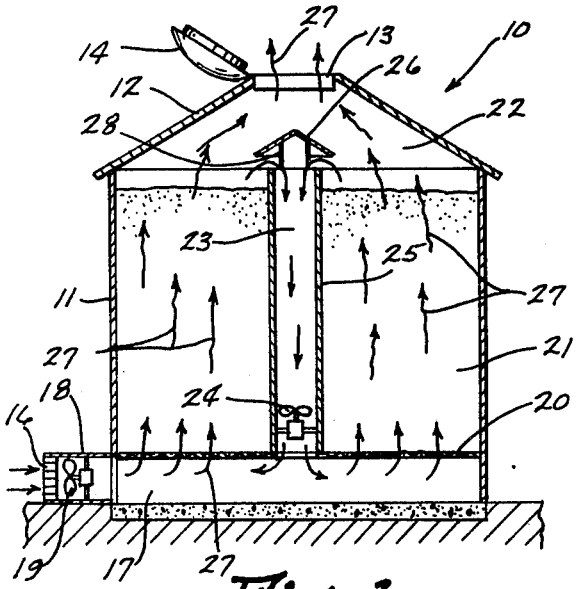
FIG. 1 is a cross-sectional view of a preferred embodiment of the present invention.
Figure 2:
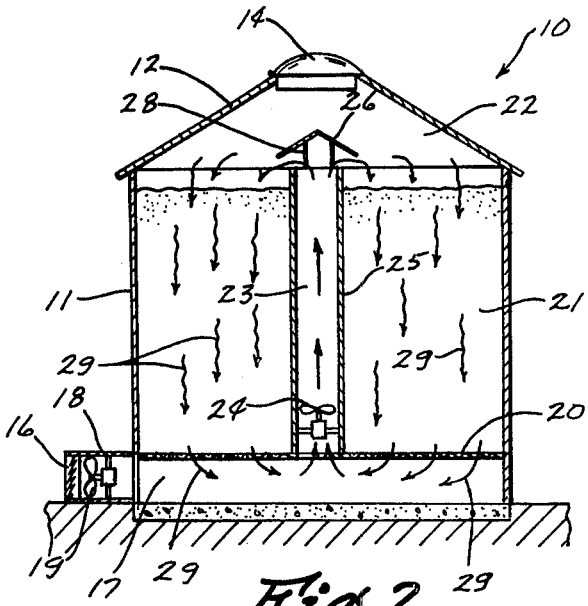
FIG. 2 is identical to FIG. 1, except the system is closed.

Referring now to the drawings wherein like reference numerals designate identical or corresponding parts throughout the several views, FIGS. 1 and 2 show a preferred embodiment of an improved grain bin 10 of the present invention. The grain bin 10 is comprised of a conventional storage bin having air impervious sidewalls 11 and a roof 12. The roof 12 has an air opening 13 in the top and center thereof and has a lid 14 which can selectively be used to open or close the opening 13. A damper mechanism 16 is connected to air intake plenum chamber 17 through a tube 18 which is attached to the sidewall 11 of the grain bin 10. This damper mechanism 16 will be explained more fully below with respect to FIGS. 3–5. Disposed within the tube 18 and between the damper mechanism 16 and the intake plenum chamber 17 is a fan 19 which is preferably electrically operated and is oriented and rotated so as to force atmospheric air into the intake plenum chamber 17. An air pervious support member 20 is disposed within the grain bin 10 and is rigidly attached to the internal face of the sidewall 11. The air pervious support member 20 is also in communication with both the intake plenum chamber 17 and a grain storage chamber 21 and forms the interface therebetween. The side of the grain storage chamber 21 opposite the intake plenum chamber 17 is in communication with an exhaust plenum chamber 22. FIGS. 1 and 2 do not show an air pervious support member at the interface of the grain storage chamber 21 and the exhaust plenum chamber 22; but, it is understood that if support is required for the stored grain in this area, for example if the structure was to be turned on its side, a member similar to the air pervious support member 20 can be utilized and will form an interface between the grain storage chamber 21 and the exhaust plenum chamber 22.

The apparatus improvement of this invention comprises several elements used in conjunction with a conventional grain bin. First, an interval tubular plenum chamber 23 is disposed essentially central to the grain storage chamber 21 and essentially perpendicular to and in communication with the intake plenum chamber 17 at one end, and in communication with the exhaust plenum chamber 22 at the other end. Walls 25 of the internal tubular plenum chamber 23 are pervious and in communication with the grain storage chamber 21 and form the interface between the internal tubular plenum chamber 23 and the grain storage chamber 21. A cone deflector 26 is shown in the embodiment of FIGS. 1 and 2 spaced above the uppermost end of and rigidly attached to wall 25 by straps 28. In this embodiment, the deflector cone 26 functions to prevent the grain, being charged to the grain bin 10 through opening 13, from entering the internal tubular plenum chamber 23. It is apparent that an air pervious capping member could perform the same function. Disposed within the internal tubular plenum chamber 23 is an internal fan means 24 which is preferably electrically operated and is oriented and rotated so as to force air to flow from one surface plenum chamber to the other.

The process of this invention is illustrated by reference to the embodiment shown in FIGS. 1 and 2. FIG. 1 shows the process being used in the normal drying state in which the grain is being brought to a "cured" condition. The "cured" condition is defined as the point at which the grain temperature and moisture are in equilibrium with the atmospheric temperature and moisture. In this open phase of the process, the grain present in the grain storage chamber 21 is exposed to a throughput of atmospheric air. With the damper mechanism 16 and the lid 14 both in an open position, the fan 19 is activated to introduce atmospheric air into the intake plenum chamber 17. The air thus introduced, as indicated by air flow lines 27, passes through the air pervious support means 20, through the grain present in the grain storage chamber 21, into the exhaust plenum chamber 22, and exhausts to the atmosphere through opening 13. The internal fan means 24 is activated to force air from the exhaust plenum chamber 22, through the internal tubular plenum chamber 23, and into the intake plenum chamber 17. The activation of the internal fan means 24 in conjunction with the fan 19 improves the efficiency of the air flow by reducing the pressure in the exhaust plenum chamber 22. The volume of atmospheric air being delivered by the fan 19 is generally of much greater capacity than the internal fan means 24, so that large volumes of air pass through the stored grain and exhaust out the opening 13 even with the internal fan means 24 drawing air from the exhaust plenum chamber 22.

FIG. 2 shows the process in the closed phase in which the grain present in the grain storage chamber 21 is exposed to air circulated within the grain bin 10. With the damper mechanism 16 and the lid 14 both in a closed position to prevent the intake or exhaust of air, the internal fan means 24 is activated to force internal circulation of air as indicated by air flow lines 29. FIG. 2 shows the internal fan means 24 forcing air from the intake plenum chamber 17 through the air pervious support member 20, through the internal tubular plenum chamber 23, into the exhaust plenum chamber 22, through the grain present in the grain storage chamber 21, back through the air pervious support member 20, and back into the intake plenum chamber 17. The air is thus recirculated within the closed grain bin 10 to achieve an approximately uniform grain moisture content throughout the mass of stored grain within the grain storage chamber 21. Although FIG. 2 shows the air flow from the intake plenum chamber 17 towards the exhaust plenum chamber 22, the direction of air flow within the grain bin 10 can be reversed by reversing the direction of rotation of the internal fan means 24.

Figure 3:
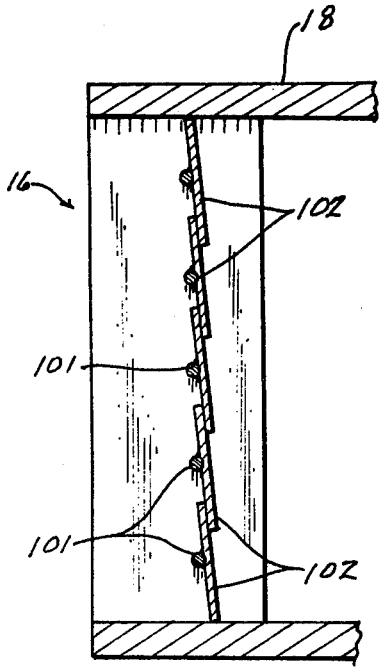
FIG. 3 is an enlarged cross-sectional view showing a damper mechanism in a closed position for use in the present invention.
Figure 4:
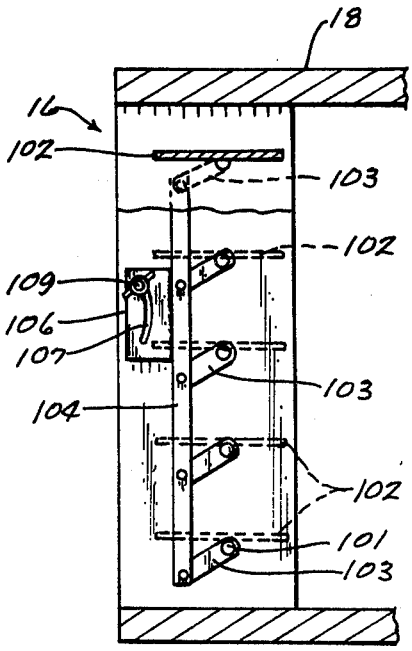
FIG. 4 is a partial cross-sectional view of the damper mechanism of FIG. 3 in an open position.
Figure 5:
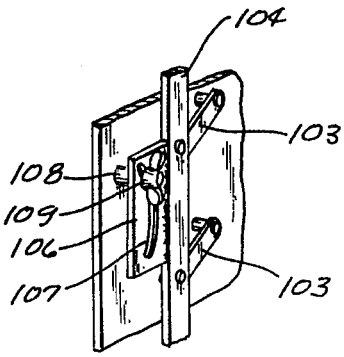
FIG. 5 is a partial perspective view of the locking and actuating mechanism of the damper mechanism shown in FIGS. 3 and 4.

Referring now to FIGS. 3–5, one example of a damper mechanism 16 is shown attached to the sidewalls 11 of a bin through a tube 18. FIG. 5 shows a plurality of rods 101 which extend from one side of the tube 18 to the other and are rotatably received at each end thereof in openings in the tube 18. A plate 102 is attached to each one of the rods 101, and these plates 102 are rotatably movable as the rods 101 are rotated. A lever 103 is rigidly attached to one end of each of the rods 101, and turning of the lever 103 causes a corresponding turning of the respective rod 101 and respective plate 102. A coupling bar 104 is pivotally attached to one end of each of the levers 103 as can be seen in FIGS. 4 and 5, and this coupling bar 104 has a plate 106 rigidly attached thereto. The plate 106 has a groove 107 disposed therein through which is disposed a bolt-like projection 108 having a wing nut 109 threadedly engaging one end thereof. The projection 108 is, of course, fixed with respect to the tube 18.

It can be seen that in FIG. 4, the damper mechanism 16 is in the open position and allows air to pass. When it is desired to close the damper mechanism 16, the wing nut 109 is loosened and the coupling bar 104 is raised up so that the bolt 108 is disposed in the lower portion of the slot 107 in the plate 106. When this has been done, the damper mechanism 16 has been closed and moved from the opened position as shown in FIG. 4 to the closed position as shown in FIG. 3. The wing nut 109 is then tightened again in order to retain the damper 16 in the closed position. When it is desired to open the damper mechanism 16 again, a reverse procedure is followed whereby the wing nut 109 is again loosened, the coupling rod 104 lowered to the position shown in FIG. 4 and the wing nut 109 then tightened again so as to retain the damper mechanism 16 in the open position.

Figure 6:
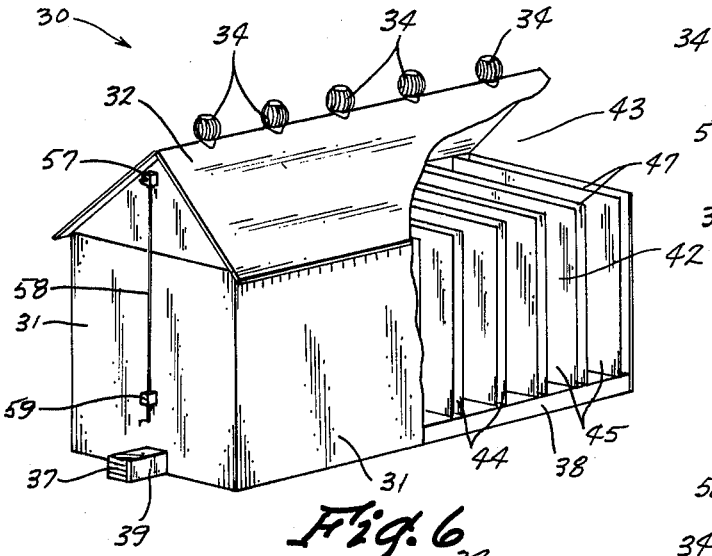
FIG. 6 is a cutaway perspective view of another preferred embodiment of the present invention.
Figure 7:
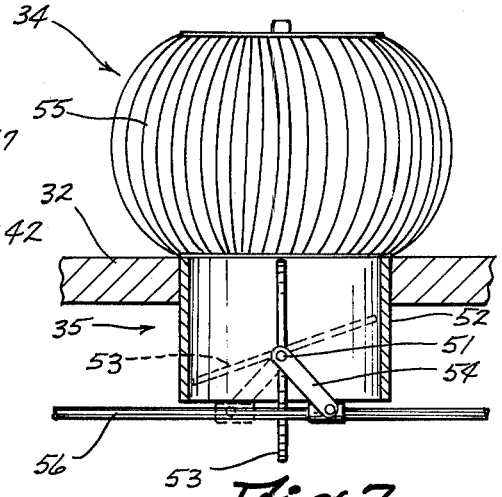
FIG. 7 is an enlarged cross-sectional view showing a turbine ventilator and a roof damper for use in the present invention.
Figure 8:
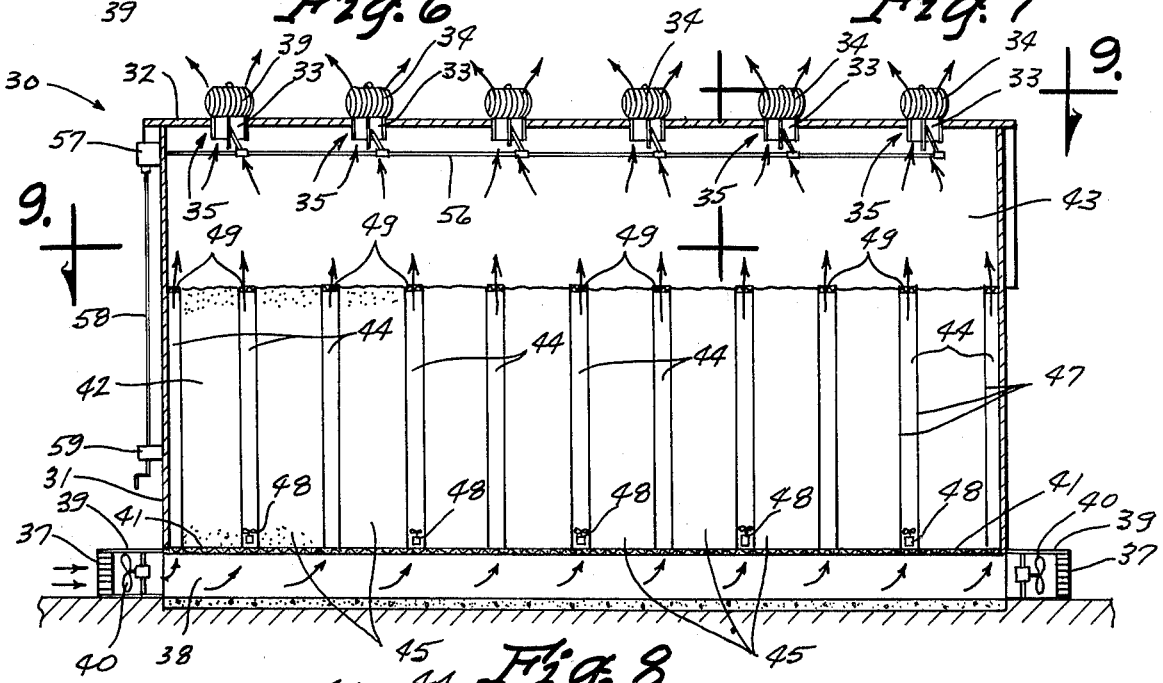
FIG. 8 is a cross-sectional view of the preferred embodiment of FIG. 6.
Figure 9:
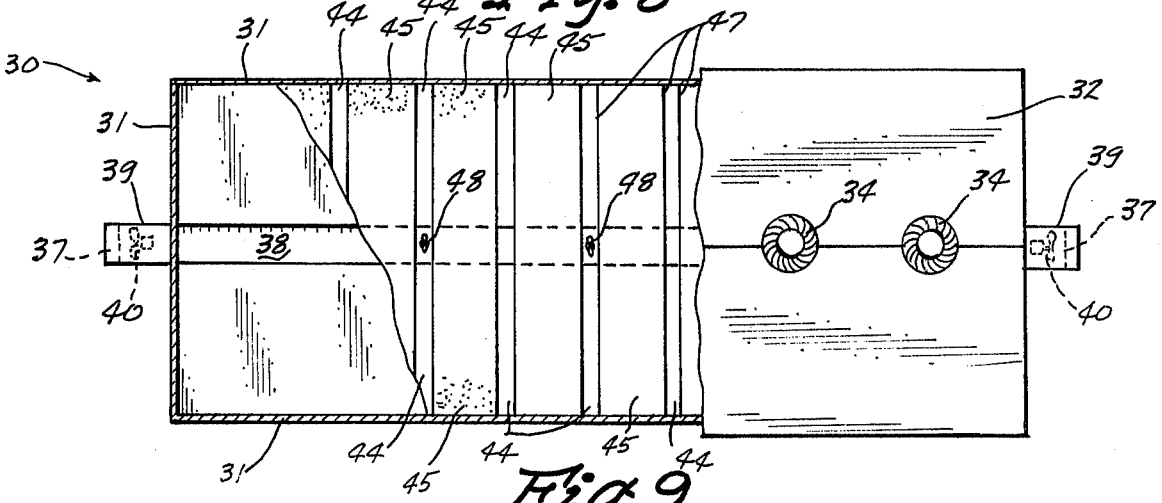
FIG. 9 is a partial cross-sectional view of the preferred embodiment of FIGS. 6 and 8.

FIGS. 6, 8 and 9 illustrate another preferred embodiment of an improved grain bin 30 of the present invention. The grain bin 30 is comprised of a conventional storage bin having air impervious sidewalls 31 and a roof 32. The roof 32 has a plurality of openings 33 spaced along the apex thereof and over said openings 33 are mounted a series of wind-powered turbine ventilators 34 which are essentially of the type shown in U.S. Pat. No. 3,041,956 and illustrated in FIG. 7. Roof dampers 35 depend downwardly from the roof 32 and can selectively be used to open and close the openings 33. The roof dampers 35 will be explained more fully below with respect to FIGS. 7 and 8. A damper mechanism 37 is connected to an intake plenum chamber 38, through a tube 39, which is attached to the sidewall 31 of the grain bin 30. The damper mechanism 37 is identical to damper mechanism 16 which is illustrated by FIGS. 3–5 and its operation has been previously discussed. Disposed within the tube 39 and between the damper mechanism 37 and the intake plenum chamber 38 is a fan 40 which is preferably electrically operated and is oriented and rotates so as to force atmospheric air from one surface plenum chamber to the other. An air pervious support member 41 is disposed within the grain bin 30 and is rigidly attached to the internal face of the sidewall 31. The air pervious support member 41 is also in communication with both the intake plenum chamber 38 and a grain storage chamber 42 and forms the interface therebetween. The side of the grain storage chamber 42 opposite the intake plenum chamber 38 is in communication with an exhaust plenum chamber 43.

The apparatus improvement of this invention, shown in this embodiment, comprises several elements used in conjunction with a conventional grain bin. As most clearly shown in FIGS. 6, 8 and 9, a plurality of essentially parallel plena 44 are disposed at intervals in the space between the intake plenum chamber 38, the exhaust plenum chamber 43 and the sidewalls 31 of the grain bin 30. The parallel plena 44 are disposed essentially perpendicular to and are in communication with the intake plenum chamber 38, the exhaust plenum chamber 43, and the bin sidewalls 31. A series of essentially parallel grain storage columns 45 are disposed in the space between the parallel plena 44 and are disposed essentially perpendicular to and in communication with the intake plenum chamber 38, the exhaust plenum chamber 43, and the sidewalls 31. Air pervious support walls 47 are disposed at the interface of the parallel plena 44 and the grain storage columns 46 and form the common wall of each adjacent parallel plenum 44 and grain storage column 46. The parallel plena 44, the grain storage columns 46, and the walls 47 occupy the entire space between the intake plenum chamber 38 and the exhaust plenum chamber 43. A series of internal ventilation fans 48 are disposed within each alternate parallel plena 44 as most clearly shown in FIGS. 8 and 14–18. The internal ventilation fans 48 are preferably electrically operated and oriented and rotated so as to force air from one surface plenum chamber to the other. Air pervious capping members 49 are disposed on the exhaust plenum chamber side of the parallel plena 44 and are in communication with and form the interface between the parallel plena 44 and the exhaust plenum chamber 43. The air pervious capping members prevent the grain being charged into the grain bin 30 through openings 33 from entering the parallel plena 44. FIGS. 14, 15, 17 and 18 show an embodiment wherein a series of air impervious capping members 50 are disposed on the exhaust plenum chamber side and essentially perpendicular to and in communication with two parallel grain storage columns 46 and the intermediate parallel plenum 44; the intermediate parallel plenum 44 being one of those within which an internal ventilation fan 48 is disposed. The air impervious capping members 50 function to prevent the flow of air directly from the parallel plena 44, into the exhaust plenum chamber 43.

FIGS. 7 and 8 show the roof damper 35, attached to the roof 32 through a damper tube 52. A rod 51 extends from one side of the damper tube 52 to the other and is rotatably received at each end thereof in openings in the damper tube 52. A damper plate 53 is attached to the rod 51 and is rotatably movable as the rod 51 is rotated. A lever 54 is rigidly attached to the rod 51, and turning of the lever 54 causes a corresponding turning of the rod 51 and the damper plate 53. A connecting bar 56 is pivotally attached to one end of the lever 54 and connects the series of roof dampers as most clearly shown in FIG. 8. The connecting bar 56 extends through an opening in the sidewall 31 into gear box 57 which is mounted on the sidewall 31. An operator shaft 58 depends downwardly from the gear box 57 and is rotatably received in bracket 59 which is mounted on the sidewall 31. Rotation of the operator shaft 58 effects a lateral movement of the connecting bar 56 which in turn causes the damper plate 53 to rotate from an open to a closed position, and the reverse.

Figure 11:
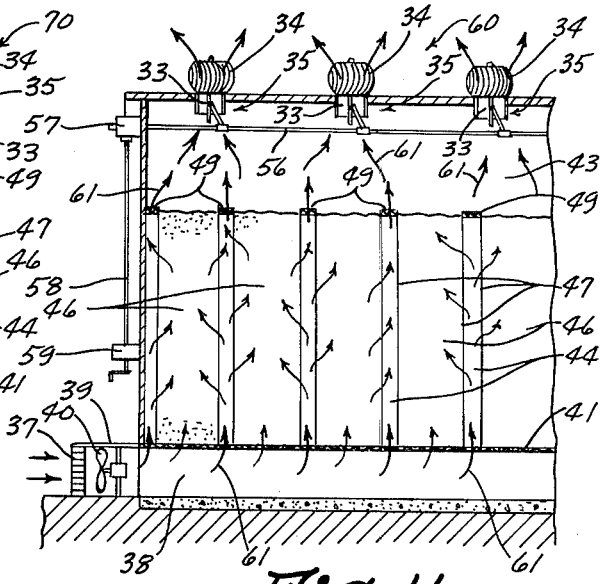
FIG. 11 is a partial cross-sectional view of yet another preferred embodiment of the present invention.

FIG. 11 shows still another grain bin structure 60 which is adequate to perform certain aspects of the present invention. The grain bin 60 is virtually identical to grain bin 30 as shown in FIGS. 6, 8 and 9, except that the internal fan means 48 has been removed. In this embodiment, the fan 40 is activated when the damper mechanism 37 and the roof damper 35 are open. When the fan 40 is rotated so as to force atmospheric air into the intake plenum chamber 38, the air flow is essentially as indicated by air flow lines 61. The air enters the intake plenum chamber 38, passes through the air pervious support member 41, through the parallel plena 44, through the air pervious capping members 49, into the exhaust plenum chamber 43, and exhausts to the atmosphere through the roof openings 33 and the turbine openings 55. The stored grain within the grain storage columns 46 is exposed to a throughput of air with a large volume of air contacting the stored grain in near proximity to the air pervious support walls 47. The turbine ventilators 34, when turned by the wind, create a suction in the exhaust plenum chamber 43 and increases the efficiency of the fan 40.

Figure 10:
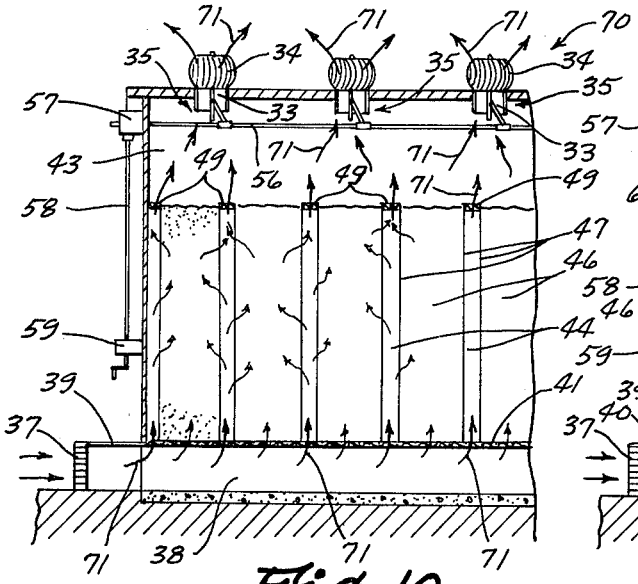
FIG. 10 is a partial cross-sectional view of still another preferred embodiment of the present invention.

FIG. 10 shows another grain bin structure 70 which is adequate to perform certain aspects of the present invention. The grain bin 70 is identical to grain bin 60 as shown in FIG. 11 except that the fan 40 has been removed. In this embodiment, when both the damper mechanism 37 and the roof dampers 35 are open, the turbine ventilators 34 are turned by the wind and this action will draw the air through the grain bin 70 essentially in the manner as shown by air flow lines 71. As in the embodiment of FIG. 11, this embodiment exposes the stored grain to a large volume of air. The air pervious support walls 47 allow for a large area of surface contact between the stored grain and the ventilating air and provides improved and efficient ventilation.

FIGS. 12, 13, 16 and 17 and FIGS. 14, 15, 18 and 19 show two additional grain bin structures 80 and 90, respectively, which are adequate to perform certain aspects of the present invention. The grain bin 80 is virtually identical to grain bin 30 shown in FIG. 8 except that the fan 40 has been removed. The grain bin 90 is, likewise, similar to grain bin 30, except that the fan 40 has been removed and air impervious capping members 50 have been added.

The embodiments of grain bins 30, 80 and 90 all employ the internal fan means 48 and thus make it possible to provide for internal circulation of the air within a closed grain bin. Additionally, grain bins 30 and 80 will provide similar air flow lines 81, 82, 83 and 84 since it is unnecessary to activate the fan 40 of the grain bin 30 when the internal fan means 48 is activated and since in the instance of simultaneous operation, the fan 40 forces air to flow in the same direction as would internal fan means 48.

The process of this invention utilizing the embodiment of grain bins 30 and 80 is illustrated by reference to FIGS. 12, 13, 16 and 17. When using the embodiment of grain bin 90, the process of the present invention is illustrated by reference to FIGS. 14, 15, 18 and 19.

Figure 12:
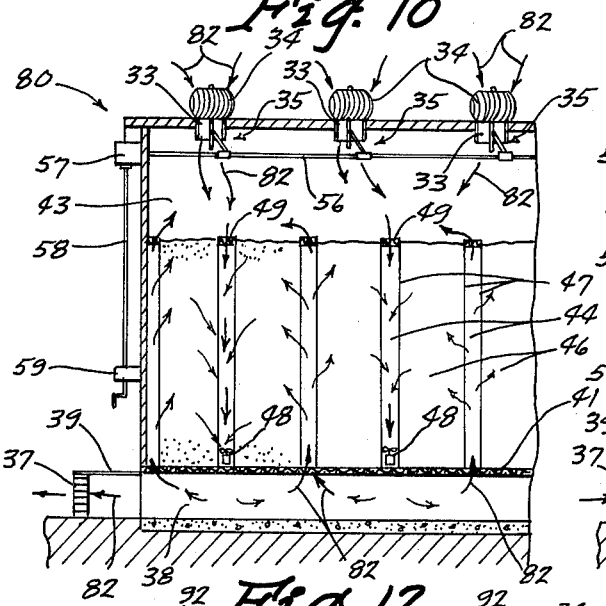
FIG. 12 is a partial cross-sectional view of an alternate preferred embodiment of the present invention.
Figure 13:
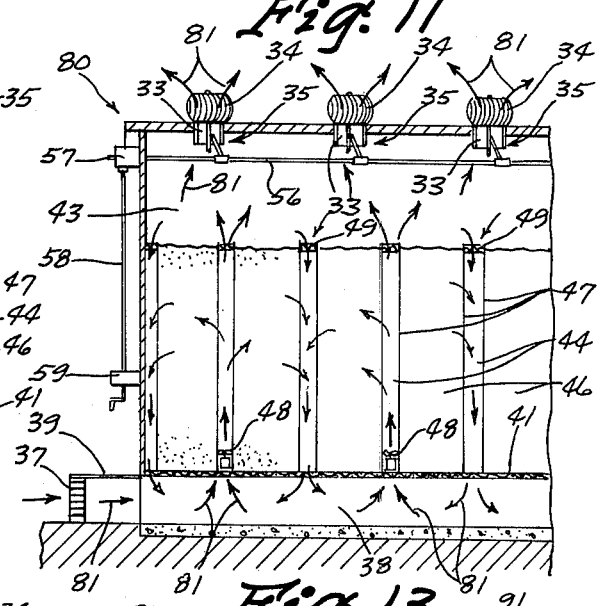
FIG. 13 is identical to FIG. 12, except the fan direction is reversed.
Figure 14:
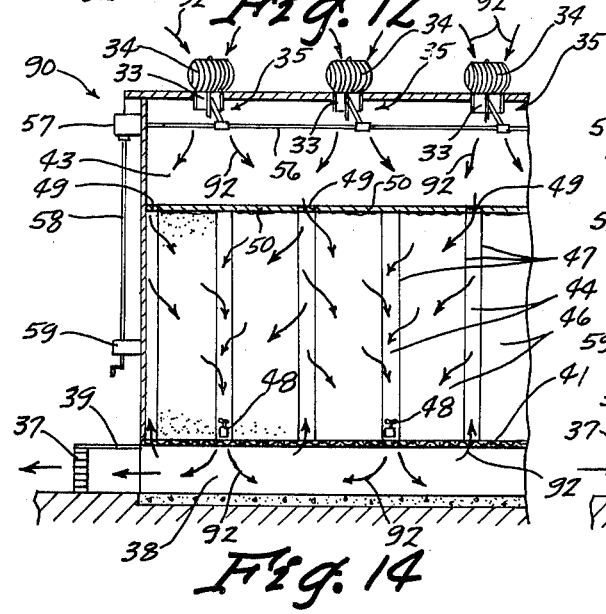
FIG. 14 is a partial cross-sectional view of another alternate preferred embodiment of the present invention.
Figure 15:
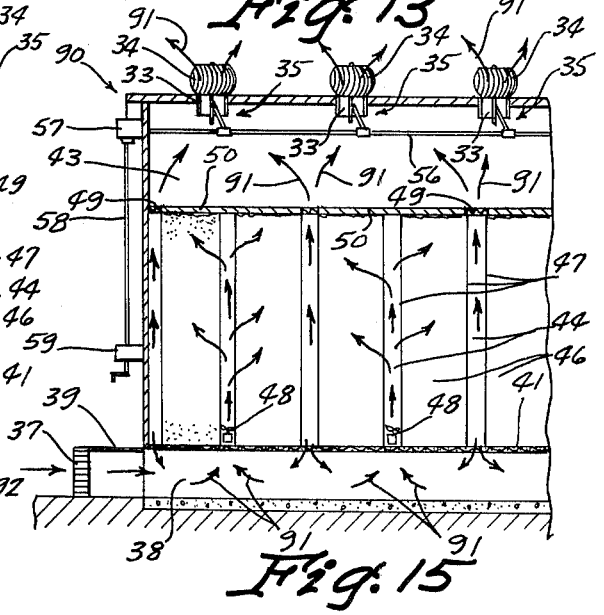
FIG. 15 is identical to FIG. 14, except the fan direction is reversed.

FIGS. 12, 13, 14 and 15 show the process being used in the normal drying state in which the grain is being brought to a "cured" condition ("cured" condition has been previously defined). In this open phase of the process, the grain present in the grain storage columns 46 is exposed to a throughput of atmospheric air. In the embodiments represented by FIGS. 12, 13, 14 and 15, the damper mechanism 37 and the roof damper 35 are both in an open position to allow the intake and exhaust of air. With the dampers thus open, the internal fan means 48 is activated to introduce atmospheric air. When the internal fan means 48 is oriented and rotated so as to force air from the intake plenum chamber 38 to the exhaust plenum chamber 43, as illustrated in FIGS. 13 and 15, the air is drawn into the intake plenum chamber 38 and passes through the air pervious support means 41 into the parallel plena 44. In the embodiment of grain bins 30 and 80, shown in FIG. 13, the air then passes through the air pervious capping member 49 and into the exhaust plenum chamber 43, from whence a portion of the air is exhausted through the openings 33 and turbine openings 55 and a portion recirculates back to the intake plenum chamber 38 all as shown by air flow lines 81; in the embodiment of grain bin 90, shown in FIG. 15, the air then passes through the air pervious support walls 47, through the stored grain within the grain storage columns 46, through the air pervious support walls 47, into the parallel plena 44, through the air pervious capping member 49, into the exhaust plenum chamber 43, and is exhausted through the openings 33 and turbine openings 55, all as shown by air flow lines 91. FIGS. 12 and 14 represent the process in the open phase wherein the internal fan means 48 is oriented and rotated so as to force air from the exhaust plenum chamber 43 towards the intake plenum chamber 38. The air flow lines 82, shown in FIG. 12, are essentially opposite the air flow lines 81, shown in FIG. 13. Likewise, the air flow lines 92, in FIG. 14, are essentially opposite the air flow lines 91 in FIG. 15. The air flow indicated by air flow lines 82 and 92 is preferably for nighttime ventilation to take advantage of the solar heat accumulated in the roof members and adjacent internal air during the day. However, the suction created by the turbine ventilator 34, when rotated by the wind, improves the efficiency of the internal fan means 48 when the air flow is in the direction as indicated by air flow lines 81 and 91.

Figure 16:
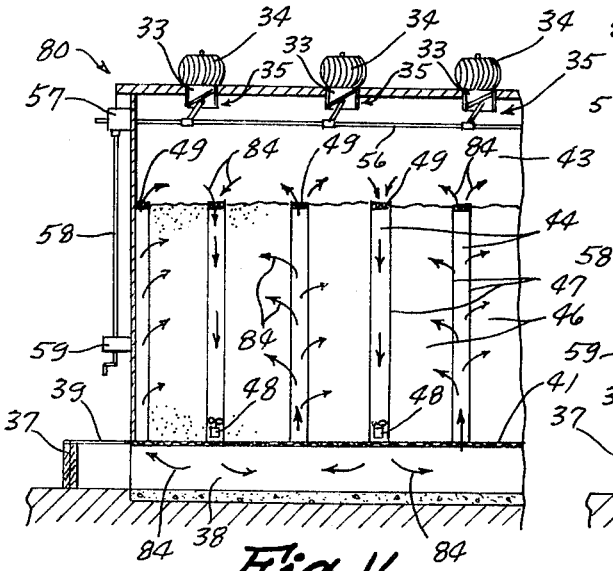
FIG. 16 is identical to FIG. 12, except the system is closed.
Figure 17:
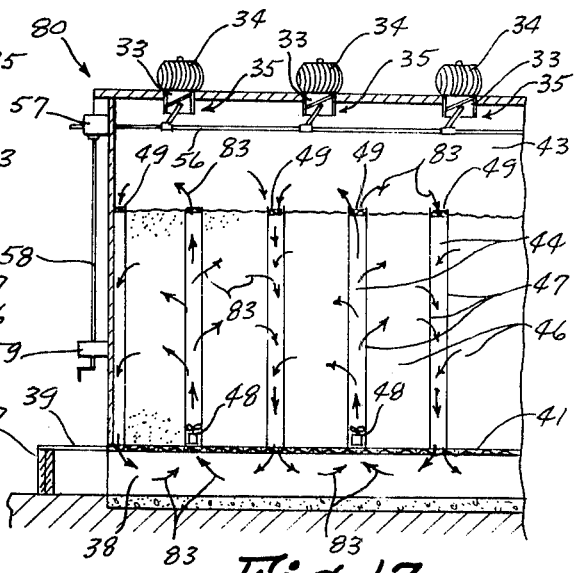
FIG. 17 is identical to FIG. 13, except the system is closed.
Figure 18:
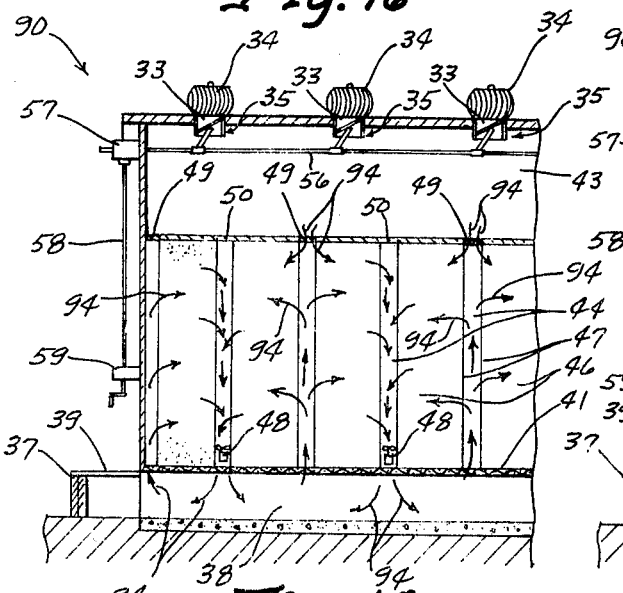
FIG. 18 is identical to FIG. 14, except the system is closed.
Figure 19:
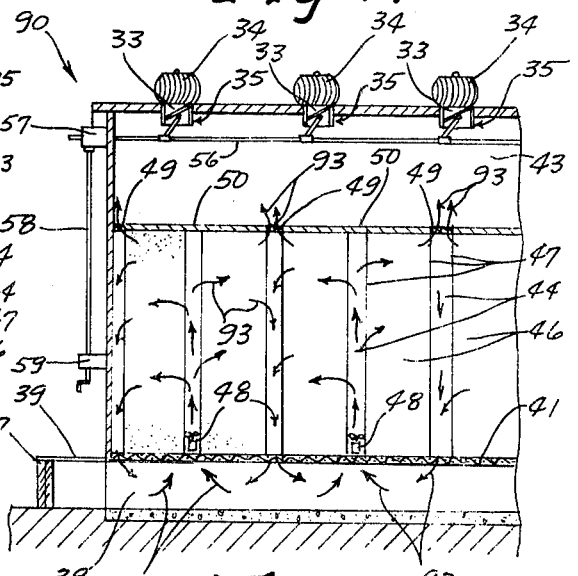
FIG. 19 is identical to FIG. 15, except the system is closed.

FIGS. 16, 17, 18 and 19 show the process in the closed phase in which the grain contained in the grain storage columns 46 is exposed to air circulated within the structure. In the embodiments represented by FIGS. 16, 17, 18 and 19, the damper mechanism 37 and the roof dampers 35 are both in the closed position to substantially prevent the intake or exhaust of air. With the dampers thus closed, the internal fan means 48 is activated to circulate air within the structure. When the internal fan means 48 is oriented and rotated so as to force air from the intake plenum chamber 38 to the exhaust plenum chamber 43, as is illustrated in FIGS. 17 and 19, the air is drawn from the intake plenum chamber 38 and passes through the air pervious support means 41 into the parallel plena 44. In the embodiment of grain bins 30 and 80, shown in FIG. 17, the air then passes through the air pervious capping member 49, into the exhaust plenum chamber 43, and recirculates back to the intake plenum chamber 38, all as shown by air flow lines 83; in the embodiment of grain bin 90, shown in FIG. 19, the air then passes through the air pervious support walls 47, through the stored grain within the grain storage columns 46, through the air pervious support walls 47, into the parallel plena 44, through the air pervious support member 41, and into the intake plenum chamber 38 from whence it is again circulated, as shown by air flow lines 93. FIGS. 16 and 18 represent the process in the closed phase wherein the internal fan means 48 is oriented and rotated as to force air from the exhaust plenum chamber 43 towards the intake plenum chamber 38. The air flow lines 84, shown in FIG. 16, are essentially opposite the air flow lines 83, shown in FIG. 17. Likewise, the air flow lines 94, in FIG. 18, are essentially opposite the air flow lines 93, in FIG. 19.

The structures embodied in grain bins 30, 60, 70, 80 and 90 are capable of utilizing ventilation with minimum supplemental air flow from energy-consuming ventilation means. The structures further provide for efficient internal circulation of air and maximize utilization of free, atmospheric resources of sun and wind in a completely natural manner. Maximum exposure of grain to air is provided by alternating grain storage columns 46 separated by parallel air plena 44, thus, minimizing power requirements to ventilate the grain.

Obviously, many modifications and variations of the present invention are possible in light of the above teachings. It is therefore to be understood that, within the scope of the appended claims, the invention may be practiced otherwise than as specifically described.

I claim:

1. An apparatus for storing seed grains including a grain bin having air impervious sidewalls, a roof, a grain storage chamber disposed within the grain bin, an intake plenum chamber disposed on one surface of the grain storage chamber, an exhaust plenum chamber disposed on the opposite surface of the grain storage chamber, said plena chambers having air pervious members where the plena chambers are in communication with the grain storage chamber, a fan means attached to said grain bin for selectively supplying atmospheric air to the intake plenum chamber, a controllable damper mechanism to substantially allow or prevent the passage of air into the intake plenum chamber, an exhaust opening in communication with the exhaust plenum chamber, and a movable lid disposed over the exhaust opening to substantially allow or prevent the exhaust of air from the grain bin, the improvement comprising:

an air pervious tubular member attached to the bin forming a tubular plenum chamber disposed essentially central to the grain storage chamber and essentially perpendicular to and in communication with the intake plenum chamber at one end, and essentially perpendicular to and in communication with the exhaust plenum chamber at the opposite end; and an internal fan means attached to the tubular member and disposed within the tubular plenum chamber at the lower portion thereof.

2. The apparatus of claim 1 wherein the internal fan means is oriented and rotated so as to force the flow of air towards the intake plenum chamber.

3. The apparatus of claim 1 wherein the internal fan means is reversible and capable of providing air flow in either direction through the tubular plenum chamber.

4. An apparatus for storing seed grains including a grain bin having air impervious sidewalls, a roof, a grain storage chamber disposed within the grain bin, an intake plenum chamber disposed on one side of the grain storage chamber, an exhaust plenum chamber disposed on the opposite side of the grain storage chamber, said plena chambers having air pervious members where the plena chambers are in communication with the grain storage chamber, a fan means attached to said grain bin for selectively forcing atmospheric air through the grain bin, a controllable damper mechanism to substantially allow or prevent the passage of air between the intake plenum chamber and the atmosphere, an opening in said roof in communication with the exhaust plenum chamber, a controllable roof damper in communication with said opening to substantially allow or prevent the passage of air between the exhaust plenum chamber and the atmosphere, and a wind-powered turbine ventilator disposed over said opening to induce the flow of air from the exhaust plenum chamber to the atmosphere, the improvement comprising:

a plurality of essentially parallel plena disposed at intervals in the space between the intake plenum chamber, the exhaust plenum chamber, and the sidewalls of the grain bin, and disposed essentially perpendicular to and in communication with the said intake plenum chamber, exhaust plenum chamber, and sidewalls;

a plurality of essentially parallel grain storage columns, separated by said parallel plena, and disposed in that space between the intake plenum chamber, the exhaust plenum chamber and the bin sidewalls not occupied by said parallel plena; and a plurality of parallel air pervious support walls attached to the grain bin and disposed between and forming a common wall of each adjacent parallel plenum and grain storage column.

5. The apparatus of claim 4 further comprising a plurality of air pervious capping members attached to the air pervious support walls and covering the parallel plena where said parallel plena are in communication with the exhaust plenum chamber.

6. The apparatus of claim 4 further comprising a plurality of internal ventilation fans attached to the air pervious support walls and disposed within each alternate parallel plena.

7. The apparatus of claim 6 wherein the internal ventilation fans are oriented and rotated so as to force the flow of air towards the exhaust plenum chamber.

8. The apparatus of claim 6 wherein the internal ventilation fans are reversible and capable of providing air flow in either direction.

9. The apparatus of claim 6 further comprising a plurality of air impervious capping members attached to the air pervious support walls on the exhaust plenum chamber side thereof and covering the two parallel grain storage columns and the intermediate parallel plenum within which the internal fan means is disposed.

10. A method of maintaining approximately uniform grain moisture content throughout a mass of stored grain within a grain storage chamber of a grain bin while preventing the overdrying of the stored grain, said method comprising:

substantially preventing the introduction of atmospheric air into the grain bin;

substantially preventing the exhaust of air from the grain bin to the atmosphere; and activating an internal ventilation fan, said fan being attached to and disposed within the lower portion of a vertically disposed plenum chamber having perforate walls, the outer surface of said perforate walls being in contact with the stored grain, said activation forcing air to pass through said vertical chamber and ventilate the stored grain while circulating within the closed grain bin.

11. A method of curing a mass of stored grain within a grain storage chamber of a grain bin, said method comprising:

forcing atmospheric air to enter the grain bin and to pass through the stored grain;

exhausting a first portion of said atmospheric air from the grain bin after said air has passed through the grain; and recirculating a second portion of said atmospheric air through a vertically disposed plenum chamber having perforate walls, the outer surface of said perforate walls being in contact with the stored grain, wherein said second portion of said atmospheric air ventilates the stored grain while recirculating within the open grain bin.

12. The method of claim 11 wherein the recirculation step is accomplished by an internal fan disposed at the lower portion of said vertically disposed plenum chamber, said internal fan being rotated to force air from an upper plenum chamber to a lower plenum chamber, said internal fan operating in conjunction with a drying fan, said drying fan being rotated to force air from the atmosphere into said lower plenum chamber.

* * * * *